US009666205B2

(12) United States Patent
Lin et al.

(10) Patent No.: US 9,666,205 B2
(45) Date of Patent: May 30, 2017

(54) VOICE ENHANCEMENT METHOD

(71) Applicant: AIROHA TECHNOLOGY CORP., Hsinchu (TW)

(72) Inventors: Heng-Chih Lin, Hsinchu (TW); Wen-Sheng Hou, Hsinchu (TW); Chien-Chen Lin, Hsinchu (TW)

(73) Assignee: Airoha Technology Corp., Hsinchu (TW)

( * ) Notice: Subject to any disclaimer, the term of this patent is extended or adjusted under 35 U.S.C. 154(b) by 0 days.

(21) Appl. No.: 14/967,786

(22) Filed: Dec. 14, 2015

(65) Prior Publication Data

US 2016/0275960 A1 Sep. 22, 2016

(30) Foreign Application Priority Data

Mar. 19, 2015 (TW) ..... 104108752 A

(51) Int. Cl.
*G10L 21/02* (2013.01)
*G10L 21/0208* (2013.01)
*G10L 21/0216* (2013.01)

(52) U.S. Cl.
CPC .... *G10L 21/02* (2013.01); *G10L 2021/02082* (2013.01); *G10L 2021/02166* (2013.01)

(58) Field of Classification Search
CPC ..... G10L 2021/02166; G10L 21/0216; G10L 21/0208; G10L 21/02; G10L 2021/02087; G10L 2021/02082
USPC ..... 704/226, 228
See application file for complete search history.

(56) References Cited

U.S. PATENT DOCUMENTS 8,321,214 B2 * 11/2012 Chan ..... H04R 3/005 704/225
9,430,931 B1 * 8/2016 Liu ..... G08B 21/24
2009/0154717 A1 * 6/2009 Hoshuyama ..... H04R 3/02 381/66
2009/0299742 A1 * 12/2009 Toman ..... G10L 21/0208 704/233
2011/0038489 A1 * 2/2011 Visser ..... G01S 3/8006 381/92
2011/0091055 A1 * 4/2011 LeBlanc ..... H04S 7/301 381/303
2011/0232989 A1 * 9/2011 Lee ..... G01S 3/8034 181/125
2011/0264447 A1 * 10/2011 Visser ..... G10L 25/78 704/208
2011/0285808 A1 * 11/2011 Feng ..... H04N 7/142 348/14.09
2011/0293103 A1 * 12/2011 Park ..... G10K 11/1782 381/57
2011/0301730 A1 * 12/2011 Kemp ..... G10L 19/008 700/94

(Continued)

FOREIGN PATENT DOCUMENTS

CN 103414988 A 11/2013
TW I230023 3/2005

*Primary Examiner* — Jakieda Jackson
(74) *Attorney, Agent, or Firm* — Rosenberg, Klein & Lee

(57) ABSTRACT

A voice enhancement method is disclosed. The method of the present invention is adapted for a distributed system. In the present invention, a plurality of picking devices are disposed in a space for picking voice signal. After determining the positions of the picking devices, an enhancement operation is performed on the waveform signals from the picking devices to generate an enhanced voice signal.

14 Claims, 4 Drawing Sheets

(56) References Cited

U.S. PATENT DOCUMENTS

| | | | | |
|---|---|---|---|---|
| 2013/0144490 | A1* | 6/2013 | Lord | B60T 17/22 701/41 |
| 2013/0268280 | A1* | 10/2013 | Del Galdo | G10L 19/02 704/500 |
| 2014/0219472 | A1* | 8/2014 | Huang | H04R 1/406 381/92 |
| 2015/0043773 | A1* | 2/2015 | Chiussi | G06T 7/0044 382/103 |
| 2016/0014490 | A1* | 1/2016 | Bar Bracha | H04M 3/56 381/92 |

* cited by examiner

VOICE ENHANCEMENT METHOD

FIELD OF THE INVENTION

The present invention is related to a voice enhancement method, more particularly to a voice enhancement method for a distributed system.

BACKGROUND OF THE INVENTION

For important meeting or conference, a place with special design or equipment is required. For example, a conference room with sound-absorbing walls or a microphone array with beamforming technology would be appreciated for people to organize an important meeting.

However, it is expensive to build such a conference room and equipment.

In modern word, the division of knowledge is more specialized and professionalized, but the fields of technique included in a project are more and more complicated. Consequently, a plurality of meetings of discussing and organizing for professionals of technical fields are needed to complete a project. The meeting occurs anytime anywhere, but a good conference room is not available anytime.

Consequently, how to provide a voice enhancement method with low cost is the problem of the community.

SUMMARY OF THE PRESENT INVENTION

It is an objective of the present invention to provide a voice enhancement method, more particularly a voice enhancement method adapted for a distributed system.

It is another objective of the present invention to provide a voice enhancement method, which determines the positions of the picking devices and the source, and performs an enhancement operation on waveform signal to generate an enhanced voice signal with low cost.

It is still another objective of the present invention to provide a voice enhancement method, wherein the positions of the picking devices are firstly determined, and then the picking devices transmit the waveform signal to each other and perform an enhancement operation on the waveform signal to generate an enhanced voice signal.

The present invention provides a voice enhancement method, adapted for a distributed system, wherein the distributed system comprises a plurality of picking devices and a host device, the plurality of picking devices are disposed in a space and communicate with the host device, wherein the voice enhancement method comprises steps of: positioning the plurality of picking devices and a source; using each of the plurality of picking devices to receive a voice signal generated by the source and generate a waveform signal corresponding to the received voice signal; using each of the plurality of picking devices to transmit the waveform signal to the host device; and performing an enhancement operation on the waveform signals and generating an enhanced voice signal.

In one embodiment of the present invention, the enhancement operation comprises determining and comparing distances between picking devices and the source and choosing the waveform signal generated by the picking device which is the closest one to the source as the enhanced voice signal.

In one embodiment of the present invention, the step of positioning the plurality of picking devices and the source is selectively one of a step of global positioning system positioning, assisted global positioning system positioning or image recognition positioning.

In one embodiment of the present invention, the enhancement operation is selectively one of a beamforming operation, an echo cancellation operation, a noise reduction operation, a de-reverberation operation, a gain boost operation or the combination thereof.

In one embodiment of the present invention, the voice enhancement method further comprises a step of transmitting the enhanced voice signal to the plurality of picking devices; wherein each of the plurality of picking devices comprises a speaker for playing the enhanced voice signal.

In one embodiment of the present invention, the plurality of picking devices communicate with the host device by wired transmission or wireless transmission.

In one embodiment of the present invention, the wireless transmission is selectively one of a Bluetooth transmission, wireless network transmission, a radio frequency transmission or an acoustic transmission.

In one embodiment of the present invention, each of the plurality of picking devices is selectively one of a speakerphone, a wired telephone, a wireless telephone, a mobile phone, a Bluetooth headset, a wired microphone, a wireless microphone, a wired speaker with microphone, a wireless speaker with microphone or a notebook computer.

In one embodiment of the present invention, the voice enhancement method further comprises a step of positioning the plurality of picking devices and the source periodically in a predetermined period.

The present invention further provides a voice enhancement, adapted for a distributed system, wherein the distributed system comprises a first picking device and at least one second picking device, the first picking device and the at least one second picking device are disposed in a space and communicate with each other, wherein the voice enhancement method comprises steps of: positioning the first picking device and the at least one second picking device; using each of the first picking device and the at least one second picking device to receive a voice signal generated by a source and generate a waveform signal corresponding to the received voice signal; using each of the at least one picking device to transmit the waveform signal to the first picking device; and performing an enhancement operation on the waveform signals and generating an enhanced voice signal.

In one embodiment of the present invention, the enhancement operation is selectively one of a beamforming operation, an echo cancellation operation, a noise reduction operation, a de-reverberation operation, a gain boost operation or the combination thereof.

In one embodiment of the present invention, each of the first picking device and the at least one second picking device comprises a speaker for playing the enhanced voice signal.

In one embodiment of the present invention, the step of positioning the first picking device and the at least one second picking device is selectively one of a step of wireless transmission positioning, acoustic transmission positioning, global positioning system positioning, assisted global positioning system positioning or image recognition positioning.

In one embodiment of the present invention, the voice enhancement method further comprises a step of positioning the first picking device and the at least one second picking device periodically in a predetermined period.

In one embodiment of the present invention, each of the first picking device and the at least one second picking device is selectively one of a speakerphone, a wired telephone, a wireless telephone, a mobile phone, a Bluetooth headset, a wired microphone, a wireless microphone, a wired speaker with microphone, a wireless speaker with microphone or a notebook computer.

DETAILED DESCRIPTION OF THE PREFERRED EMBODIMENTS

Figure 1:
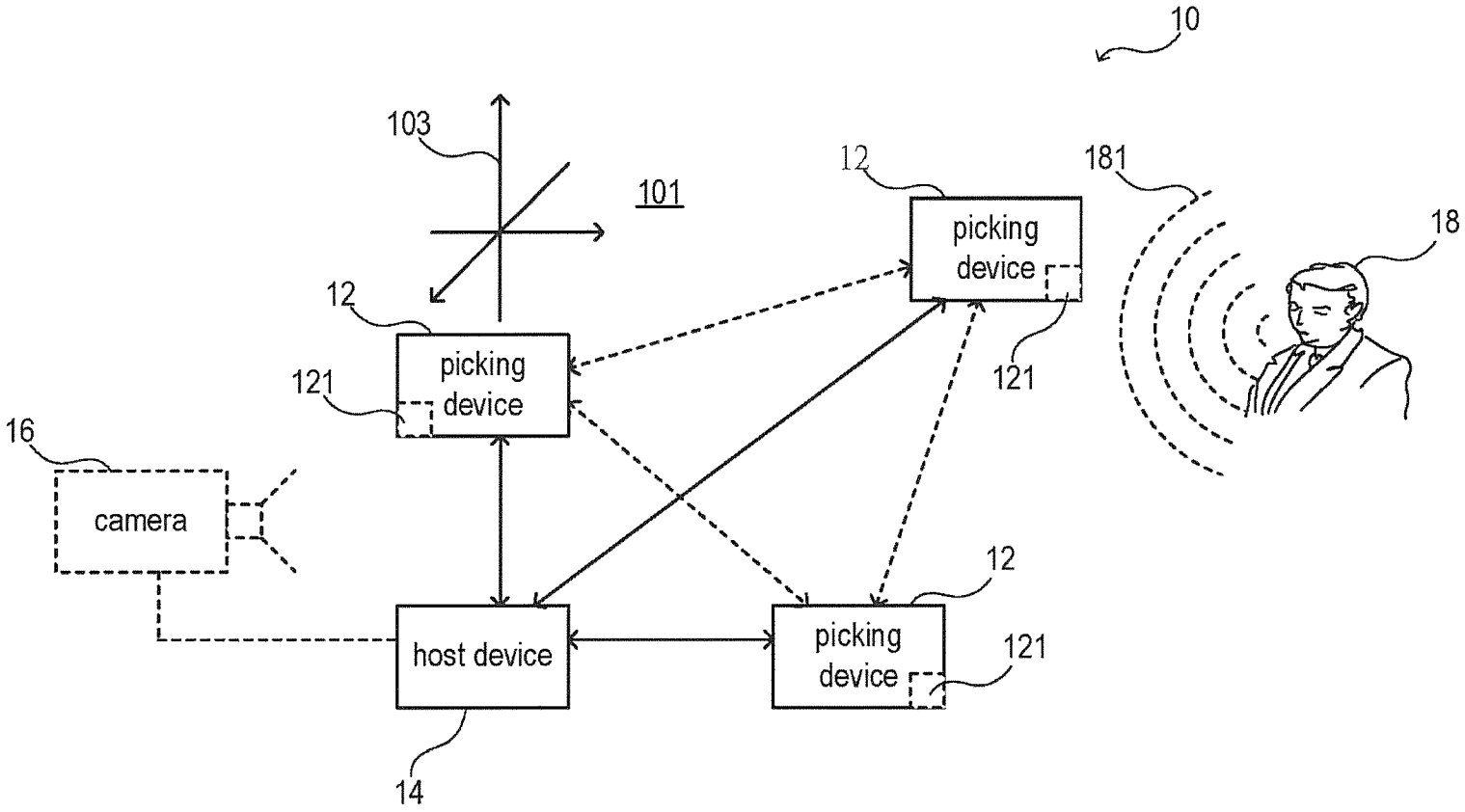
FIG. 1 is a schematic diagram showing a distributed system in accordance with one embodiment of the present invention.
Figure 2:
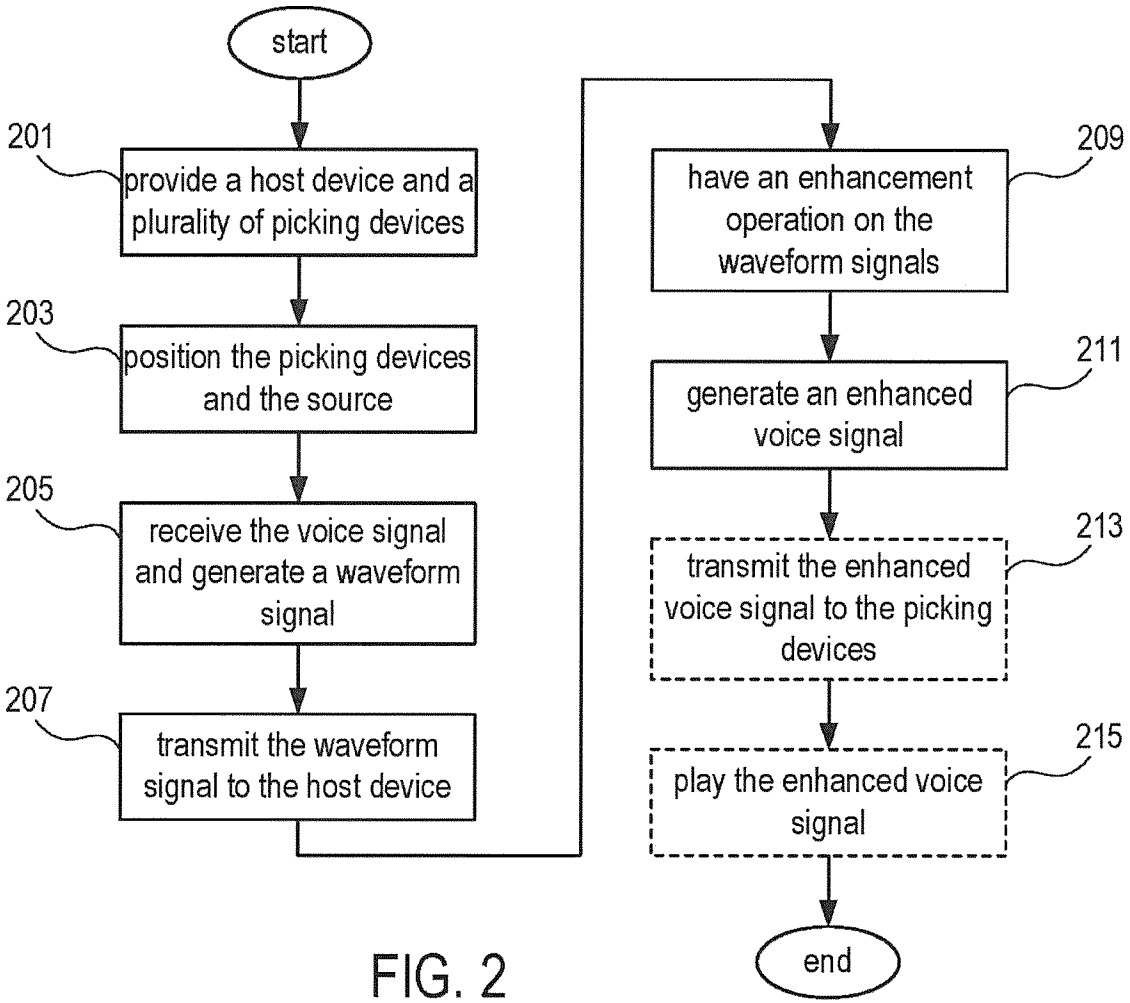
FIG. 2 is a flowchart showing a voice enhancement method in accordance with one embodiment of the present invention.

Referring to FIGS. 1 and 2, there are shown a schematic diagram showing the distributed system and the flowchart in accordance with one embodiment of the present invention. The distributed system 10 of the present invention comprises a plurality of picking devices 12 and a host device 14. The picking devices 12 are distributed within a space 101 for receiving a voice signal 181 generated by a source 18. Each of the picking devices 12 communicates with the host device 14. In the voice enhancement method of the present invention, a host device 14 and a plurality of picking devices 12 of the distributed system 10 are firstly provided in the space 101; and the positions of the plurality of picking devices 12 and the source 18 are determined, as shown in steps 201 and 203. Each of the plurality of picking devices 12 picks up a voice signal 181 generated by the source 18 and generates a waveform signal corresponding to the received voice signal 181, as shown in step 205.

And then, each of the plurality of picking devices 12 transmits generated waveform signal to the host device 14, as shown in step 207.

Finally, the host device 14 performs an enhancement operation on the waveform signals generated by the plurality of picking devices 12 and generates an enhanced voice signal, as shown in steps 209 and 211.

In one embodiment of the present invention, the enhancement operation comprises comparing the distances between the picking devices 12 and the source 18 and choosing the waveform signal generated by the picking device 12 which is the closest one to the source 18 as the enhanced voice signal. The present embodiment is the simplest embodiment of the present invention. It chooses the waveform signal generated by the picking device 12 which is the closest one to the source 18. Since the picking device 12 is the closest one to the source 18, the received voice signal 181 has the highest intensity and the intensity of the noise is relatively low, choosing the waveform signal as the enhanced voice signal takes the least resource and operation.

In one embodiment of the present invention, the step of positioning the picking devices 12 and the source 18 can be performed by using global positioning system (GPS) positioning, assisted global positioning system (AGPS) positioning or image recognition positioning. In one embodiment of the present invention, if each of the picking devices 12 and the source 18 comprises a GPS signal receiver, the step of positioning is performed by GPS positioning. In another embodiment of the present invention, if each of the picking devices 12 and the source 18 comprises an AGPS system, the step of positioning is performed by AGPS positioning. For example, if the picking devices 12 and the source 18 are all mobile phones, the step of positioning can be performed by AGPS positioning. In still another embodiment of the present invention, if the distributed system 10 comprises a camera 16, the step of positioning can be performed by image recognition positioning.

After determining the positions (or relative positions) of the picking devices 12, a coordinate 103 can be constructed in the space 101. When the source 18 generates a voice signal 181, the picking devices 12 receive the voice signal 181 at different locations. Because of the differences of locations and distances, the voice signal 181 received by the picking devices 12 comprise different intensities and phases. By performing beamforming operation according to the positions of the picking devices 12 in the coordinate 103 and the correlations between the waveform signals generated by the picking devices 12, the echo cancellation operation, noise reduction operation, de-reverberation operation and gain boost operation for voice enhancement can be achieved.

In one embodiment of the present invention, the communications between the picking devices 12 and the host device 14 are selectively performed by one of wired transmission or wireless transmission. The wireless transmission is selectively one of a Bluetooth transmission, a wireless network (Wi-Fi) transmission, a radio frequency transmission, or an acoustic transmission.

In one embodiment of the present invention, each picking device 12 comprises a speaker 121 for displaying the enhanced voice signal. The voice enhancement method of the present invention further comprises steps of transmitting the enhanced voice signal to each of the plurality of picking devices 12 and playing the enhanced voice signal by using the speakers 121 of the picking devices 12, as shown in steps 213 and 215. In the present invention, the enhanced voice signal can further be transmitted to a remote device (not shown) via network or other communication vehicle and played by the remote device for remote conference participants.

In one embodiment of the present invention, the picking device 12 is selectively one of a speakerphone, a wired telephone, a wireless telephone, a mobile phone, a Bluetooth headset, a wired microphone, a wireless microphone, a wired speaker with microphone, a wireless speaker with microphone or a notebook computer.

In one embodiment of the present invention, the voice enhancement method further comprises a step of positioning the picking devices 12 periodically in a predetermined period. In one embodiment of the present invention, the picking devices 12 are embodied by the hand-carried electronic devices of the conference participants, such as a mobile phone, a Bluetooth headset, or a notebook computer. When the participants move or the picking devices 12 are moved, the relative positions of the picking devices 12 and the source 18 are changed, and repositioning of the picking devices 12 and the source 18 should be performed for voice enhancement operation.

Figure 3:
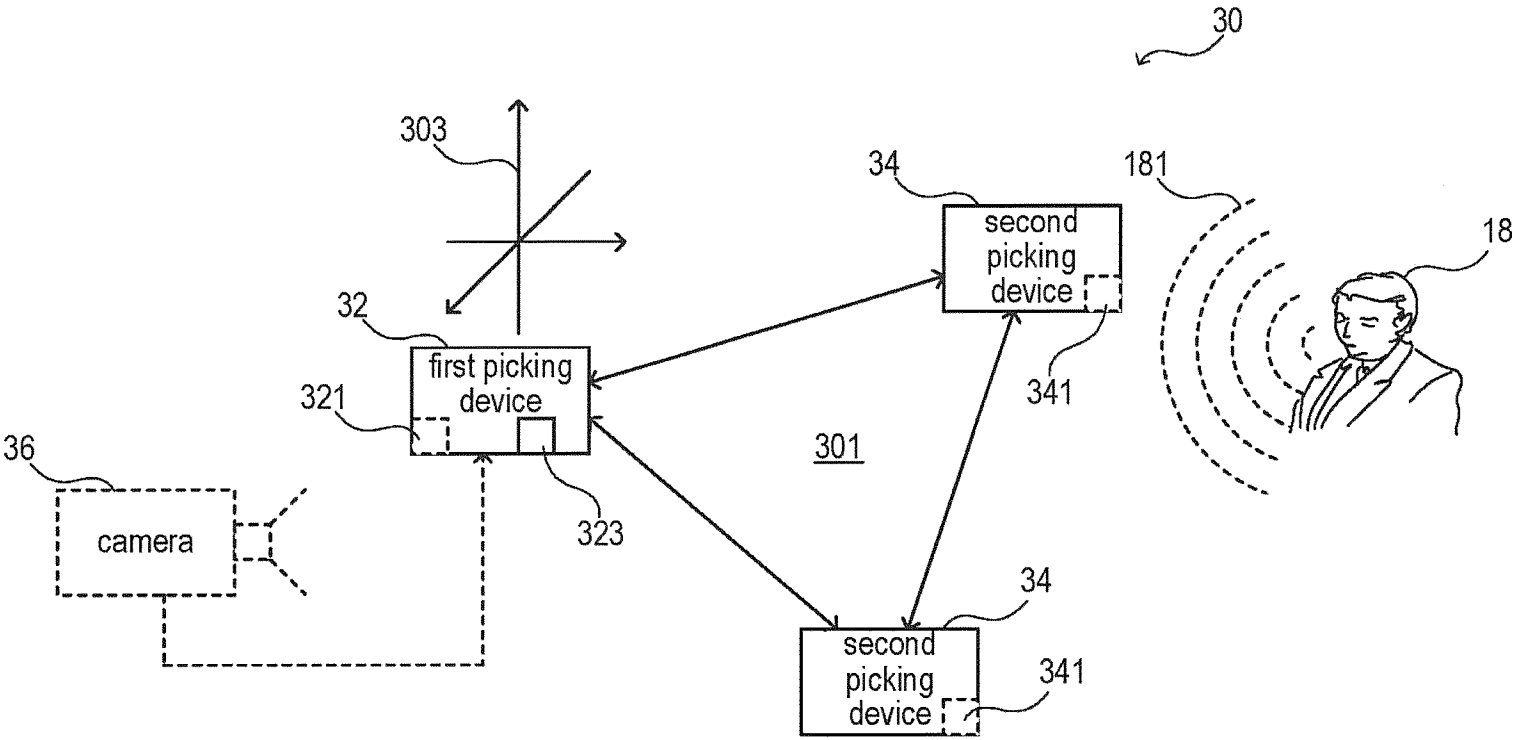
FIG. 3 is a schematic diagram showing a distributed system in accordance with another embodiment of the present invention.
Figure 4:
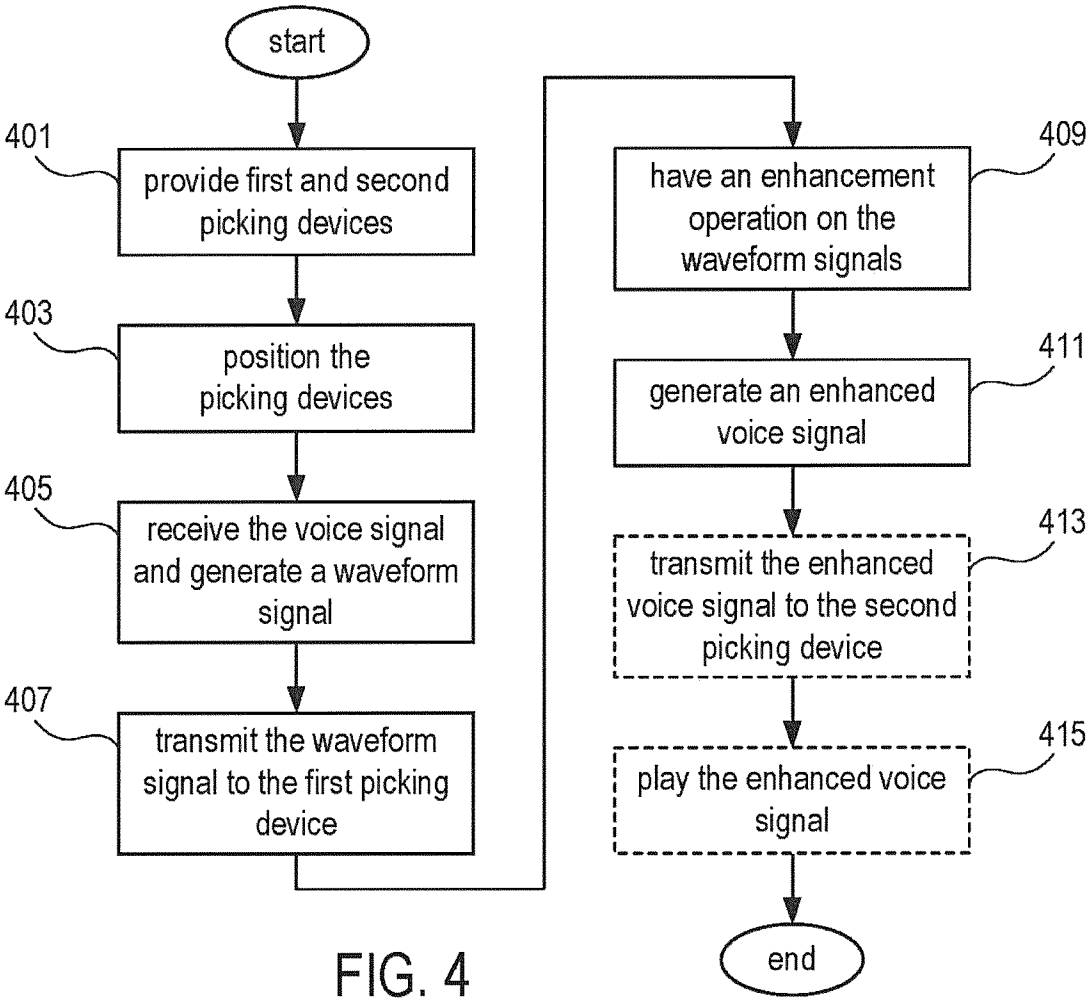
FIG. 4 is a flowchart showing a voice enhancement method in accordance with another embodiment of the present invention.

Referring to FIGS. 3 and 4, there are shown a schematic diagram showing the distributed system and the flowchart in accordance with another embodiment of the present invention. The distributed system 30 of the present embodiment comprises a first picking device 32 and at least one second picking device 34. The first picking device 32 and the second picking device 34 are disposed in a space 301. The first picking device 34 and the at least one second picking device 34 communicate with each other.

In the voice enhancement method of the present embodiment, a first picking device 32 and at least one second picking device 34 of the distributed system 30 are provided in the space 301; and the positions of the first picking device 32 and the at least one second picking device 34 are determined, as shown in steps 401 and 403. Each of the first picking device 32 and the at least one second picking device 34 picks up a voice signal 181 generated by a source 18 and generates a waveform signal corresponding to the received voice signal 181, as shown in step 405. And then, each second picking device 34 transmits the waveform signal to the first picking device 32, as shown in step 407. Finally, the first picking device 32 performs an enhancement operation on the waveform signals generated by the first picking device 32 and the second picking device 34 and generates an enhanced voice signal, as shown in steps 409 and 411.

In the present invention, since the first picking device 32 and the at least one second picking device 34 communicate with each other the distance and relative position between the first picking device 32 and the second picking device 34 can be determined by the communication protocols and the parameters of signal transmission. When the picking devices 32 and 34 communicate with each other by wireless transmission, the relative positions of the picking devices 32 and 34 can be determined by Bluetooth transmission positioning, wireless network (Wi-Fi) transmission positioning or radio frequency transmission positioning, according to the transmission protocol between the first picking device 32 and the second picking device 34. If the picking devices 32 and 34 communicate with each other by wired transmission, the relative position of the first picking device 32 and the second picking device 34 can be determined by wired transmission positioning. The positions of the first picking device 32 and the second picking device 34 can also be determined by global positioning system (GPS) positioning or assisted global positioning system (AGPS) positioning, if the picking devices 32 and 34 comprise GPS receivers or AGPS receivers.

In one embodiment of the present invention, the picking devices 32 and 34 can communicate with each other by acoustic transmission. The positions of the picking devices 32 and 34 can be determined by acoustic transmission positioning. The distances between the picking devices 32 and 34 can be determined by calculating the attenuation of the intensity of the acoustic signal, and the coordinate 303 can be constructed according to the distances between the picking devices 32 and 34.

In one embodiment of the present invention, the distributed system 30 of the present invention further comprises a camera 36 connected to or disposed on the first picking device 32 for obtaining the images of the space 301. The images of the space 301 are transmitted to the first picking device 32 to perform an image recognition operation for positioning the first picking device 32, the second picking device 34 and the source 18. In the present embodiment, when the position of the source 18, the first picking device 32 or the second picking device 34 is changed, the relative positions of the source 18, the first picking device 32 and the second picking device 34 can be calibrated immediately.

After determining the positions (or relative positions) of the first picking device 32, the second picking device 34, a coordinate 303 is constructed in the space 303. According to the positions of the first picking device 32 and the second picking device 34 in the coordinate 303, the position of the source 18 in the coordinate 303 can also be determined. By performing beamforming operation according to the correlations between the waveform signals generated by the picking devices 32 and 34, the echo cancellation operation, noise reduction operation, de-reverberation operation and gain boost operation for voice enhancement can be achieved.

In one embodiment of the present invention, each of the first picking device 32 and the second picking device 34 comprises a speaker 321 or 341. The voice enhancement method further comprises steps of: transmitting the enhanced voice signal to the second picking device 34, and using the speaker 321 and 341 of the first picking device 32 and the second picking device 34 to play the enhanced voice signal, as shown in steps 413 and 415. In the present invention, the enhanced voice signal can further be transmitted to a remote device (not shown) via network or other communication vehicle and played by the remote device for remote conference participants.

In one embodiment of the present invention, the voice enhancement method further comprises a step of positioning the first picking device 32 and the second picking device 34 periodically in a predetermined period.

In one embodiment of the present invention, each of the first picking device 32 and the second picking device 34 is selectively one of a speakerphone, a wired telephone, a wireless telephone, a mobile phone, a Bluetooth headset, a wired microphone, a wireless microphone, a wired speaker with microphone, a wireless speaker with microphone or a notebook computer.

Although particular embodiments of the invention have been described in detail for purposes of illustration, various modifications and enhancements may be made without departing from the scope of the invention specified by the claims.

What is claimed is:

1. A voice enhancement method, adapted for a distributed system having a plurality of picking devices and a host device, wherein the plurality of picking devices are disposed in a space and communicate with the host device, the voice enhancement method comprising:

acquiring positions of each of the plurality of picking devices and a source;

actuating each of the plurality of picking devices to receive a voice signal generated by the source and generate a waveform signal corresponding to the received voice signal;

actuating each of the plurality of picking devices to transmit the waveform signal to the host device;

performing an enhancement operation on the waveform signals based on the relative positions of the picking and host devices and the source, and generating an enhanced voice signal, the enhancement operation including determining and comparing distances between picking devices and the source and selecting the waveform signal generated by the picking device closest to the source as the enhanced voice signal;

transmitting the enhanced voice signal to at least one other picking device; and actuating at least one of the plurality of picking devices to play the enhanced voice signal.

2. The voice enhancement method as claimed in claim 1, wherein the positioning of the plurality of picking devices and the source is selected from the group consisting of: global positioning system positioning, an assisted global positioning system positioning, and an image recognition positioning.

3. The voice enhancement method as claimed in claim 2, wherein the enhancement operation is selected from the group consisting of: a beamforming operation, an echo cancellation operation, a noise reduction operation, a dereverberation operation, a gain boost operation, and a combination thereof.

4. The voice enhancement method as claimed in claim 1, wherein each of the plurality of picking devices includes a speaker for playing the enhanced voice signal.

5. The voice enhancement method as claimed in claim 1, wherein the plurality of picking devices communicate with the host device by wired transmission or wireless transmission.

6. The voice enhancement method as claimed in claim 5, wherein the wireless transmission is selected from the group consisting of: a Bluetooth transmission, wireless network transmission, a radio frequency transmission, and an acoustic transmission.

7. The voice enhancement method as claimed in claim 1, wherein each of the plurality of picking devices is selected from the group consisting of: a speakerphone, a wired telephone, a wireless telephone, a mobile phone, a Bluetooth headset, a wired microphone, a wireless microphone, a wired speaker with microphone, a wireless speaker with microphone, and a notebook computer.

8. The voice enhancement method as claimed in claim 1, further comprising positioning the plurality of picking devices and the source periodically in a predetermined period.

9. A voice enhancement method, adapted for a distributed system having a first picking device and at least one second picking device, wherein the first picking device and the at least one second picking device are disposed in a space and communicate with each other, the voice enhancement method comprising:

acquiring positions of each of the first picking device and the at least one second picking device, and determining a position of the source based thereon;

actuating each of the first picking device and the at least one second picking device to receive a voice signal generated by the source and generate a waveform signal corresponding to the received voice signal;

actuating the at least one second picking device to transmit the waveform signal thereof to the first picking device;

performing an enhancement operation on the waveform signals based on the relative positions of the first and second picking devices and the source, and generating an enhanced voice signal, the enhancement operation including determining and comparing distances between first and second picking devices and the source and selecting the waveform signal generated by the picking device closest to the source as the enhanced voice signal;

transmitting the enhanced voice signal to the at least one second picking device; and actuating the at least one second picking device to play the enhanced voice signal.

10. The voice enhancement method as claimed in claim 9, wherein the enhancement operation is selected from the group consisting of: a beamforming operation, an echo cancellation operation, a noise reduction operation, a dereverberation operation, a gain boost operation, and a combination thereof.

11. The voice enhancement method as claimed in claim 9, wherein each of the first picking device and the at least one second picking device includes a speaker for playing the enhanced voice signal.

12. The voice enhancement method as claimed in claim 9, wherein the positioning of the first picking device and the at least one second picking device is selected from the group consisting of: wireless transmission positioning, acoustic transmission positioning, global positioning system positioning, assisted global positioning system positioning, and image recognition positioning.

13. The voice enhancement method as claimed in claim 9, further comprising positioning the first picking device and the at least one second picking device periodically in a predetermined period.

14. The voice enhancement method as claimed in claim 9, wherein each of the first picking device and the at least one second picking device is selected from the group consisting of: a speakerphone, a wired telephone, a wireless telephone, a mobile phone, a Bluetooth headset, a wired microphone, a wireless microphone, a wired speaker with microphone, a wireless speaker with microphone, and a notebook computer.

* * * * *